US007545099B2

(12) United States Patent
Rehn

(10) Patent No.: US 7,545,099 B2
(45) Date of Patent: Jun. 9, 2009

(54) BULB FOR DISCHARGE LAMPS

(75) Inventor: Henning Rehn, Berlin (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 492 days.

(21) Appl. No.: 11/313,845

(22) Filed: Dec. 22, 2005

(65) Prior Publication Data

US 2006/0220560 A1 Oct. 5, 2006

(30) Foreign Application Priority Data

Dec. 23, 2004 (DE) ..... 10 2004 062 265

(51) Int. Cl.
*H01J 17/16* (2006.01)

(52) U.S. Cl. ..... 313/634; 313/574; 313/493

(58) Field of Classification Search ..... 313/634–636, 313/574–576, 493
See application file for complete search history.

(56) References Cited

U.S. PATENT DOCUMENTS 6,094,008 A * 7/2000 Omori et al. ..... 313/634
6,246,170 B1 * 6/2001 Sugawara ..... 313/570
7,224,107 B2 * 5/2007 Moench et al. ..... 313/114
2003/0209986 A1 * 11/2003 Ishigami et al. ..... 313/641

FOREIGN PATENT DOCUMENTS

EP 1 104 009 5/2001
JP 05 041197 2/1993

* cited by examiner

*Primary Examiner*—Peter J Macchiarolo
*Assistant Examiner*—Donald L Raleigh

(57) ABSTRACT

A bulb for a discharge lamp, includes an inner burner chamber, the outer contour of the bulb and the burner chamber each having a central region and adjacent edge regions, each central region being toroidal, and each edge region of the burner chamber adapted to be in the form of a truncated cone away from the central region and rotationally symmetrically with respect to the bulb axis, at a specific angle of taper. The midpoints of the circle segments, which form the central region of the outer contour and of the burner chamber, have a distance in the direction of the bulb axis; and/or the angles of taper of the two edge regions of the burner chamber are not the same; and/or the bulb axis lies between the circle segment, which forms the central region of the outer contour and/or of the burner chamber, and its midpoint.

15 Claims, 3 Drawing Sheets

BULB FOR DISCHARGE LAMPS

TECHNICAL FIELD

The present invention relates to a bulb for discharge lamps, in particular for short-arc discharge lamps.

BACKGROUND ART

Discharge lamps are nowadays used in many sectors, for example as projection light sources.

In this case, a discharge lamp always comprises a bulb or burner, for example made from quartz glass, which has a burner chamber filled with gas. This burner chamber, the so-called drum, which is filled, for example, with xenon, other noble gases or metal vapors, for example mercury, contains two mutually opposite electrodes, between which the discharge takes place.

The geometric shape of known bulbs has been developed historically and optimized empirically. In particular, for reasons of manufacture, both the outer contour of the bulb and the shape of the drum are always rotationally symmetrical with respect to the bulb axis.

With the bulb according to the prior art, both the outer contour of the bulb and the drum have a central region, which is toroidal. This means that the section through one of these central regions with any desired plane containing the bulb axis is a circle segment having the radius r, whose midpoint has a distance R with respect to the bulb axis. In previous bulb designs, the midpoint of this circle segment is between this circle segment and the bulb axis (R>0).

The midpoints of the circle segments belonging to the central regions of the outer contour of the bulb and the drum are in this case in the same normal plane with respect to the bulb axis, with the result that the two toroids are concentric.

These central regions merge continuously with edge regions with mirror symmetry with respect to this normal plane, said edge regions being in the form of a truncated cone in the case of the drum, and tubular in the case of the outer contour. There is a constriction having predetermined radii between the central and the tubular region of the outer contour.

With known bulbs, both the outer contour and the shape of the drum are therefore always not only rotationally symmetrical with respect to the bulb axis but also have mirror symmetry with respect to the normal plane.

These symmetries are particularly advantageous when producing the bulb from glass, in particular quartz glass, and also bring about a high mechanical strength with respect to the gas pressure in the drum.

With known bulbs having the above-described geometrical shape, the optical efficiency, i.e. the ratio of consumed current to output light, is not yet optimal, however.

DISCLOSURE OF THE INVENTION

The invention is based on the object of providing a bulb for discharge lamps having a higher optical efficiency.

In order to achieve this object, a first embodiment of a bulb for a discharge lamp has been developed, which comprises an inner burner chamber, the outer contour of the bulb and the burner chamber each having a central region and adjacent edge regions, each central region being toroidal such that the section through the central region with any desired plane containing the bulb axis comprises a circle segment which has a segment radius (r) and whose midpoint is spaced apart from this bulb axis by a rotation radius (R), the midpoints of the circle segments, which form the central region of the outer contour and of the burner chamber, have a distance z in the direction of the bulb axis; and/or the bulb axis lies between the midpoint of the circle segment, which forms the central region of the outer contour and/or of the burner chamber, and this circle segment (R<0).

This object can further be achieved by developing a second embodiment of a bulb for a discharge lamp, which comprises an inner burner chamber, the outer contour of the bulb and the burner chamber each having a central region and adjacent edge regions, each central region being toroidal such that the section through the central region with any desired plane containing the bulb axis comprises a circle segment which has a segment radius (r) and whose midpoint is spaced apart from this bulb axis by a rotation radius (R), and each edge region of the burner chamber being in the form of a truncated cone away from the central region and rotationally symmetrical with respect to the bulb axis, at a specific angle of taper ($\alpha$), the angles of taper ($\alpha_1$, $\alpha_2$) of the two edge regions of the burner chamber are not the same.

Particularly advantageous further embodiments of the invention are described in the dependent claims.

A bulb for a discharge lamp according to the first embodiment comprises, in a manner known per se, an inner burner chamber, the outer contour of the bulb and the burner chamber each having a central region and adjacent edge regions, each central region being toroidal.

This means that this central region is brought about by the displacement of a circle segment, which has a segment radius and whose midpoint lies on the bulb axis, normal to this bulb axis about a rotation radius and rotation of the circle segment about this bulb axis.

A bulb according to the first embodiment also has one or a combination of the following features:

the midpoints of the circle segments, which form the central region of the outer contour and of the burner chamber, have a distance in the direction of the bulb axis; and/or the bulb axis lies between the circle segment, which forms the central region of the outer contour and/or of the burner chamber, and its midpoint.

A bulb for a discharge lamp according to the second embodiment comprises, in a manner known per se, an inner burner chamber, the outer contour of the bulb and the burner chamber each having a central region and adjacent edge regions, each central region being toroidal, and each edge region of the burner chamber being in the form of a truncated cone away from the central region and rotationally symmetrical with respect to the bulb axis, at a specific angle of taper.

In the case of a bulb according to the second embodiment, these angles of taper of the two edge regions of the burner chamber are not of equal size.

In addition, a bulb according to the second embodiment may also have one or a combination of the following features:

the midpoints of the circle segments, which form the central region of the outer contour and of the burner chamber, have a distance in the direction of the bulb axis, and/or the bulb axis lies between the circle segment, which forms the central region of the outer contour and/or of the burner chamber, and its midpoint.

The above-described changes in the geometrical shape of the central region of the outer contour and/or of the burner chamber and/or of the edge regions of the burner chamber in accordance with the first and/or second embodiment have surprisingly resulted in a markedly higher useful luminous efficiency of bulbs according to the invention. The useful luminous efficiency could be increased compared with conventional burners by up to 20%. By suitably selecting the abovementioned parameters (distance of the midpoints of the circle segments in the direction of the bulb axis, difference in the angles of taper and displacement of one or more circle segments towards the bulb axis), the bulb with a given reflector can be optimized with respect to the luminous flux by a certain shield.

The angle of taper of one of the two edge regions of the burner chamber is preferably in the range between 22° and 60°, particularly preferably between 30° and 45°, the angle of taper of the other edge region is preferably in the range between 0° and 30°, preferably between 10° and 20°. In particular, angles of taper of 0° are also possible, with the result that a tubular edge region is provided in place of a tapering truncated cone. The length of each edge region may be selected in an appropriate manner, for example, such that the overall length of the burner chamber remains unchanged when compared with a conventional drum. It is also possible for one or both edge regions to have a diminishing length, and for the burner chamber to thus essentially only comprise the central toroidal region.

As long as the discharge lamp having a bulb according to the invention has a reflector, the midpoint of the circle segment, which forms the central region of the outer contour or of the burner chamber, is advantageously displaced in the direction of the bulb axis, while the other midpoint is arranged in the plane of the first focal point of the reflector. In the same way it is preferred for the reflector-side edge region of the burner chamber to have the larger angle of taper and for the other edge region to have the smaller angle of taper.

The circle segment, which forms the central region of the outer contour and/or of the burner chamber, is advantageously displaced towards the bulb axis such that the burner chamber and/or the wall thickness of the bulb in the central region is the same as that for the bulb according to the prior art. Manufacturing tools and methods which are sometimes present can thus be maintained, and empirically determined optima for these values can be used.

BRIEF DESCRIPTION OF THE DRAWINGS

The invention will be explained in more detail below with reference to preferred exemplary embodiments. In the drawings.

BEST MODE FOR CARRYING OUT THE INVENTION

Figure 1:
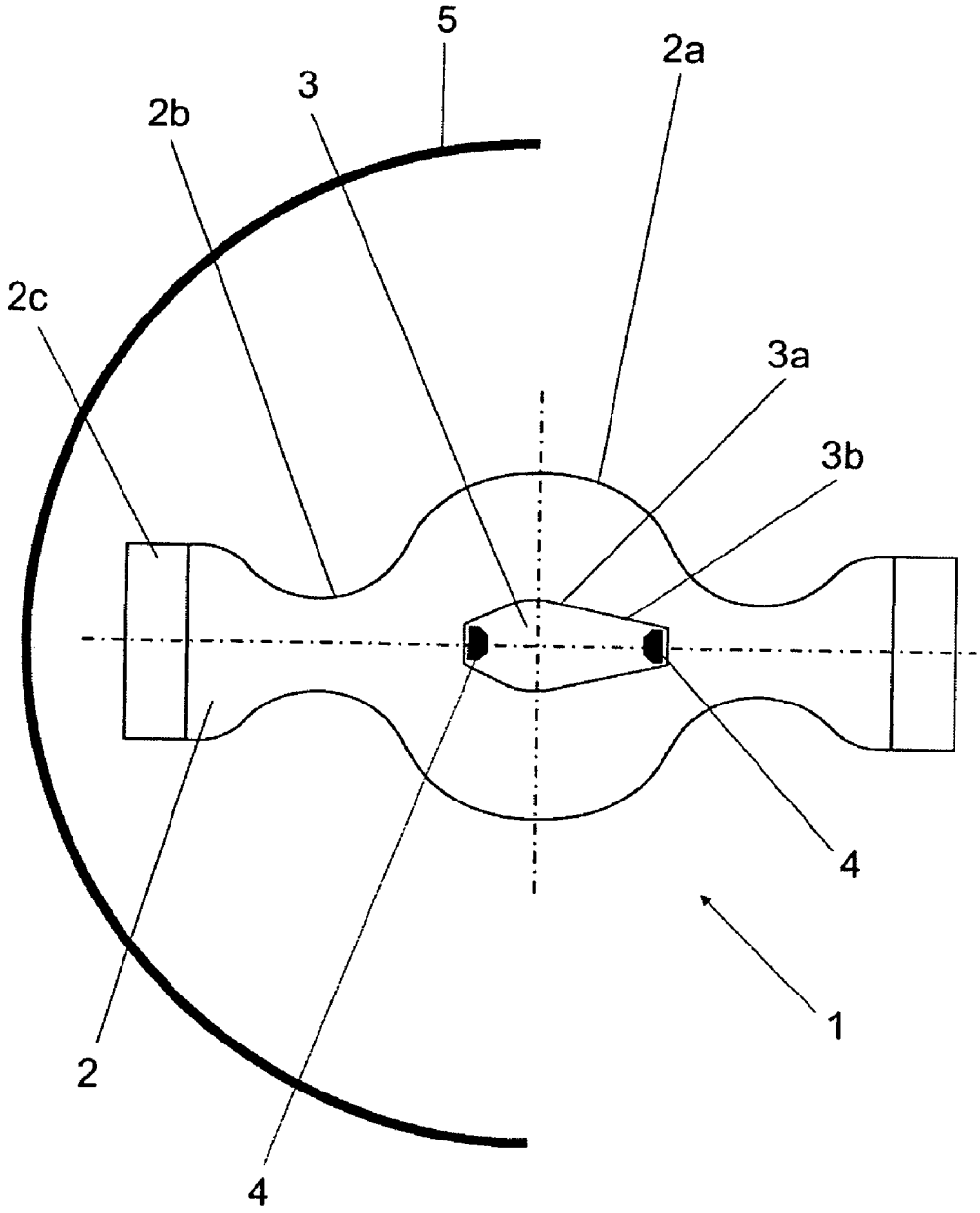
FIG. 1 shows a schematic illustration of a discharge lamp in accordance with a first embodiment of the present invention.

FIG. 1 is a schematic illustration of a discharge lamp 1 having a bulb 2 according to the invention. An elliptical reflector 5 is arranged around said bulb 2 and concentrates the light produced by the burner in the secondary focal plane.

Figure 2:
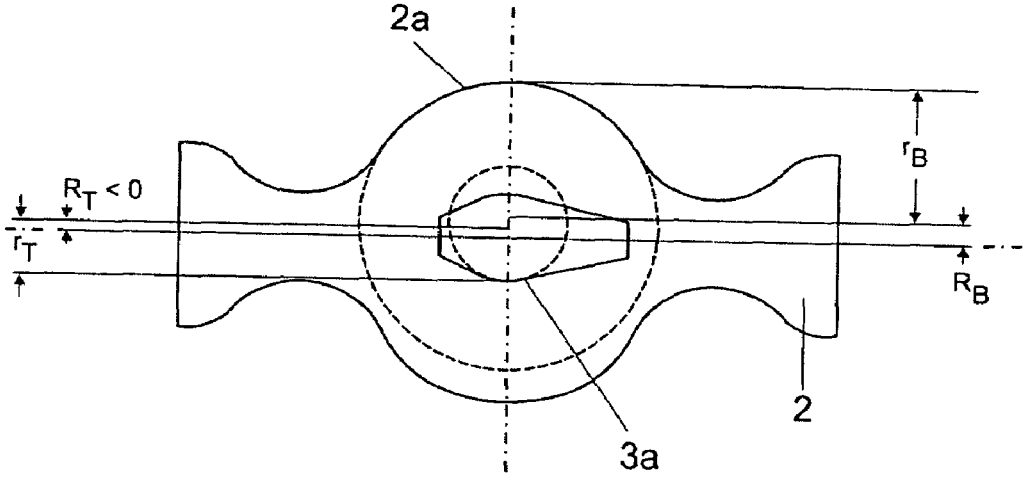
FIG. 2 shows the bulb shown in FIG. 1 with characteristic values for the central region.

The bulb 2 has an outer contour having a central region 2*a*, which is toroidal. In relation to this, FIG. 2 shows the corresponding characteristic values. The midpoint of the circle segment (radius $r_B$), which is formed by a section of the outer contour with any desired plane containing the bulb axis, has a distance $R_B$ with respect to the bulb axis which may be positive or negative.

The outer contour can be considered to have resulted from the fact that a segment of a circle, which has a radius $r_B$ and whose midpoint is on the bulb axis, is displaced normal to this bulb axis through a rotation radius $R_B$. If, in this case, the circle segment, as shown in FIG. 2, is displaced away from the bulb axis in the direction of the circle segment, the rotation axis is positive ($R_B>0$), and, when there is a displacement over the bulb axis in the opposite direction, it is negative ($R_B<0$). Then, the circle segment rotates about the bulb axis and in the process brushes over the central region 2*a* of the outer contour.

An edge region 2*b* adjoins both sides of this central region and, for its part, adjoins a shaft region 2*c* and is constricted with respect to said shaft region 2*c*. The geometrical shape of the edge region and the shaft region of the bulb is not essential to the present invention and may correspond to that of bulbs in the prior art.

The bulb has a burner chamber 3 which is filled with gas or metal vapor and in which electrodes 4 are arranged. The connection of the electrodes is not illustrated in the schematic figures for reasons of improved clarity.

The burner chamber also has a toroidal central region 3*a*, whose characteristic values are shown in FIG. 2. As shown in FIG. 2, the midpoint of the corresponding circle segment is displaced beyond the bulb axis.

The burner chamber can be considered to have resulted from the fact that the midpoint of a circle segment with the radius $r_T$ is displaced away from the bulb axis normal to this bulb axis through a rotation radius $R_T$. In FIG. 2, the bulb axis lies between the circle segment and its midpoint, i.e. the rotation radius is negative ($R_T<0$). Of equal significance in this regard, the rotation radius is negative precisely when the maximum distance from the bulb axis to the covered surface is smaller than the segment radius.

Then, the circle segment rotates about the bulb axis and in the process brushes over the central region 3*a* of the burner chamber.

Figure 3:
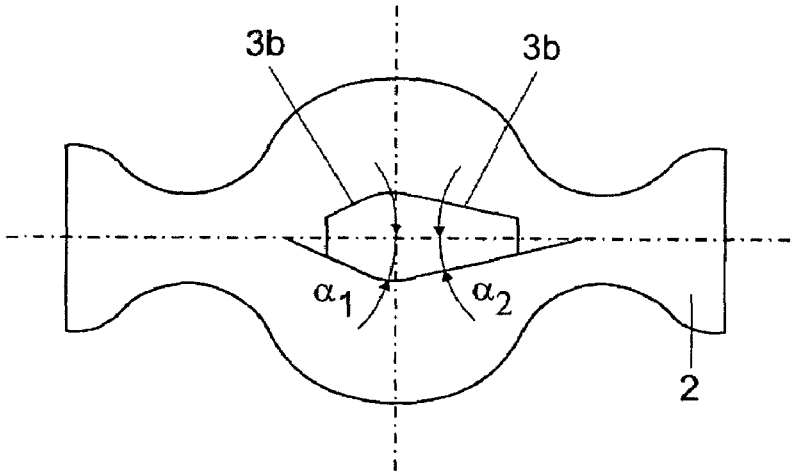
FIG. 3 shows the bulb shown in FIG. 1 with characteristic values for the edge region.

An edge region 3*b* in the form of a truncated cone adjoins this central region on both sides and tapers from the central region 3*a* outwards rotationally symmetrically with respect to the bulb axis at a specific angle of taper $\alpha_1$ or $\alpha_2$ (FIG. 3). The burner chamber is fused closed at the end.

The angles of taper $\alpha_1$ and $\alpha_2$ of the two edge regions of the burner chamber are not of equal size in this case. The region facing the reflector 5 is markedly steeper than is conventional in the prior art, and the remote region is markedly flatter.

Figure 4:
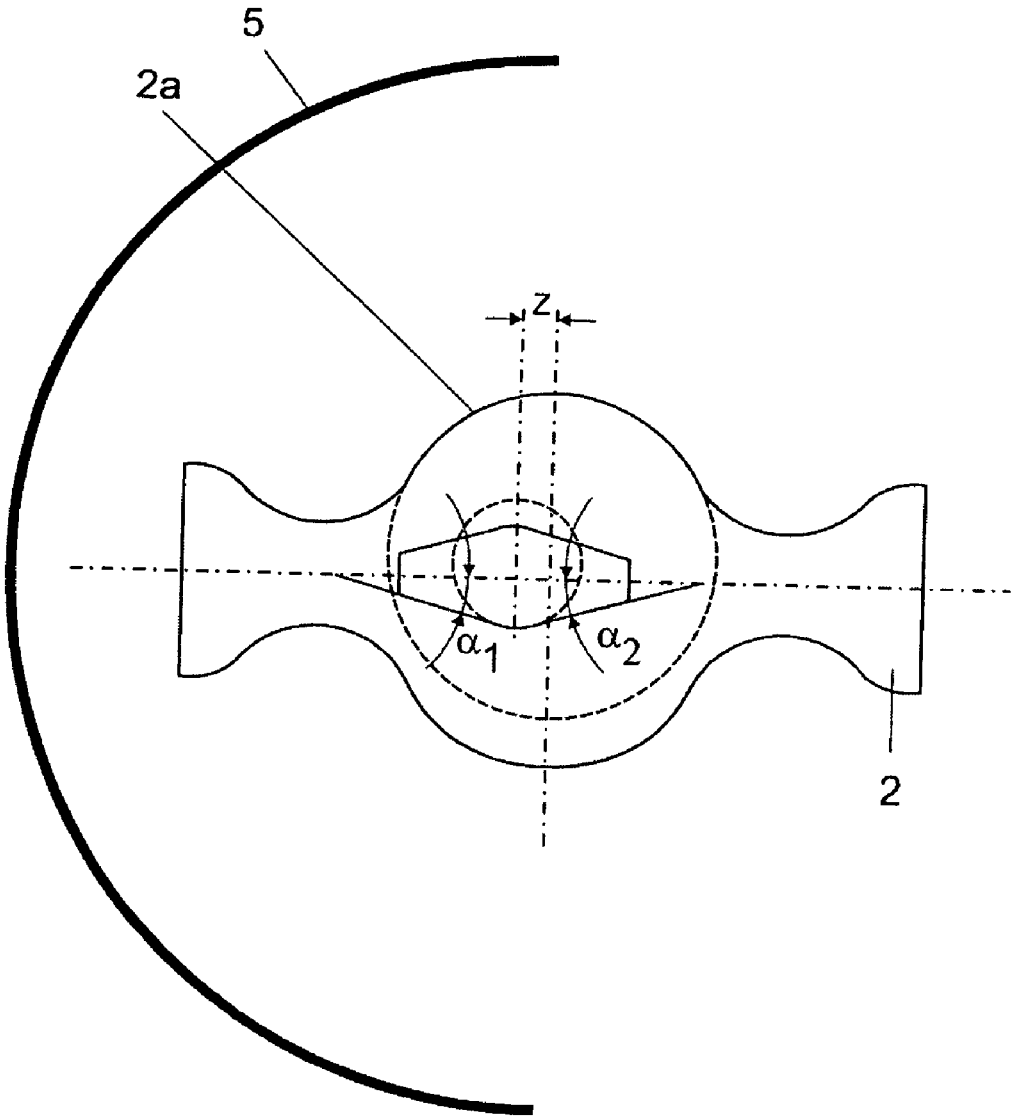
FIG. 4 shows a bulb in accordance with a second embodiment of the present invention.

FIG. 4 shows an example of a bulb in accordance with a second embodiment of the present invention. In this case, the central region 3*a* of the burner chamber, indicated by the dashed circle, whose segment brushes over the toroidal region, is displaced with respect to the central region 2*a* of the outer contour by a distance z in the direction of the bulb axis. The central region of the burner chamber is advantageously displaced in the direction of the reflector 5. In this case, the midpoint of the central circle of the outer contour preferably remains in the first focal point of the reflector 5.

In other words, the midpoints of the segments of the circles (indicated using dashed lines in FIG. 4) which form the toroidal central regions of the outer contour and of the burner chamber have a distance z in the direction of the bulb axis.

Table 1 shows, by way of example, segment radii (r) and rotation radii (R) of the outer contour ($r_B$, $R_B$) and the burner chamber ($r_T$, $R_T$), the angles of taper $\alpha_1$ and $\alpha_2$, the distance z of the midpoints of the circle segments in the direction of the bulb axis and the increase $\Delta$ in the useful luminous flux which is achieved compared with standard bulbs according to the prior art ("SdT") and specified by way of example in the first line by means of a shield of 5.0×3.8 $mm^2$ in the secondary focal plane of an elliptical reflector having the numerical eccentricity e=0.774. As explained, negative radii indicate a displacement of the circle segment beyond the bulb axis.

TABLE 1

| Bulb | $R_T$ [mm] | $r_T$ [mm] | $\alpha_1$ [°] | $\alpha_2$ [°] | $R_B$ [mm] | $r_B$ [mm] | Z [mm] | Δ [%] |
|---|---|---|---|---|---|---|---|---|
| SdT | 0 | 2.1 | 17 | 17 | 0.3 | 4.8 | −0.6 | |
| 1 | −1.6 | 3.7 | 33 | 11 | −0.9 | 6.2 | −0.4 | 10 |
| 2 | −0.2 | 2.2 | 15 | 4 | −1.3 | 6.6 | 0 | 10 |
| 3 | 0 | 2.0 | 35 | 13 | 0.3 | 4.8 | 0 | 10 |
| 4 | 0 | 2.6 | 36 | 14 | 0.3 | 4.8 | 0.2 | 9 |
| 5 | −1.6 | 3.6 | 27 | 4 | −0.8 | 6.6 | 0 | 8 |
| 6 | −1.8 | 4.4 | 57 | 22 | −1.45 | 7.38 | −0.8 | 16 |
| 7 | −1.21 | 4.0 | 43 | 15 | −1.83 | 7.69 | 0.1 | 15 |
| 8 | −0.92 | 4.0 | 38 | 27 | −1.16 | 7.25 | −0.6 | 15 |
| 9 | −1.39 | 4.0 | 33 | 21 | −1.51 | 7.54 | −0.5 | 15 |
| 10 | −2.26 | 4.9 | 49 | 14 | −1.68 | 7.99 | −0.2 | 14 |

By suitable selection of the various parameters, but in particular by abandoning the symmetry with respect to the normal plane in relation to the bulb axis of the burner, it is therefore possible according to the invention to match the bulb more effectively to the optical characteristics of a reflector. Nevertheless, the rotational symmetry, which is important for manufacture and for the optical characteristics, with respect to the bulb axis is maintained. Many tried and tested parameters which are important for lamp operation, for example the wall thickness of the bulb and the volume of the burner chamber, may also remain unchanged compared to the prior art.

List of references

| | |
|---|---|
| 1 | Discharge lamp |
| 2 | Bulb |
| 2a | Central region of the bulb |
| 2b | Edge region of the bulb |
| 2c | Shaft region |
| 3 | Burner chamber ("drum") |
| 3a | Central region of the burner chamber |
| 3b | Edge region of the burner chamber |
| 4 | Electrodes |
| 5 | Reflector |
| $R_T$ | Rotation radius of the burner chamber ("drum") |
| $r_T$ | Segment radius of the burner chamber |
| $R_B$ | Rotation radius of the bulb ("burner") |
| $r_B$ | Segment radius of the bulb |

What is claimed is:

1. A bulb for a discharge lamp, which comprises an inner burner chamber, the outer contour of the bulb and the burner chamber each having a central region and adjacent edge regions, each central region being toroidal such that the section through the central region with any desired plane containing the bulb axis comprises a circle segment which has a segment radius r and whose midpoint is spaced apart from this bulb axis by a non-zero rotation radius R, the midpoints of the circle segments, which form the central region of the outer contour and of the burner chamber, have a distance z in the direction of the bulb axis; and/or the bulb axis lies between the midpoint of the circle segment, which forms the central region of the outer contour and/or of the burner chamber, and this circle segment.

2. A bulb for a discharge lamp, which comprises an inner burner chamber, the outer contour of the bulb and the burner chamber each having a central region and adjacent edge regions, each central region being toroidal such that the section through the central region with any desired plane containing the bulb axis comprises a circle segment which has a segment radius r and whose midpoint is spaced apart from this bulb axis by a rotation radius R, and each edge region of the burner chamber being in the form of a truncated cone away from the central region and rotationally symmetrical with respect to the bulb axis, at a specific angle of taper α, the angles of taper $\alpha_1$, $\alpha_2$ of the two edge regions of the burner chamber are not the same.

3. The bulb for a discharge lamp as claimed in claim 2, wherein the midpoints of the circle segments, which form the central region of the outer contour and of the burner chamber, have a distance z in the direction of the bulb axis; and/or the bulb axis lies between the midpoint of the circle segment, which forms the central region of the outer contour and/or of the burner chamber, and this circle segment.

4. The bulb for a discharge lamp as claimed in claim 1, wherein the midpoints of the circle segments, which form the central region of the outer contour and of the burner chamber, have a distance z in the range from 0 to 1 mm in the direction of the bulb axis.

5. The bulb for a discharge lamp as claimed claim 2, wherein the angle of taper $\alpha_1$ of a first of the two edge regions of the burner chamber is in the range between 22° and 60°.

6. The bulb for a discharge lamp as claimed in claim 2, wherein the angle of taper $\alpha_2$ of a second of the two edge regions of the burner chamber is in the range between 0° and 30°.

7. The bulb for a discharge lamp as claimed in claim 5, wherein the first of the edge regions faces a reflector.

8. The bulb for a discharge lamp as claimed in claim 1, wherein the circle segment of the central region of the burner chamber has a radius of 2.2 to 4 mm.

9. The bulb for a discharge lamp as claimed in claim 1, wherein the circle segment of the outer contour has a radius of 6 to 8 mm.

10. The bulb for a discharge lamp as claimed in claim 1, wherein the circle segment, which forms the central region of the outer contour and/or of the burner chamber, is displaced towards the bulb axis such that the wall thickness of the bulb is 1.5 to 3 mm in the central region.

11. The bulb for a discharge lamp as claimed in claim 3, wherein the midpoints of the circle segments, which form the central region of the outer contour and of the burner chamber, have a distance z in the range from 0 to 1 mm in the direction of the bulb axis.

12. The bulb for a discharge lamp as claimed claim 3, wherein the angle of taper $\alpha_1$ of a first of the two edge regions of the burner chamber is in the range between 22° and 60°.

13. The bulb for a discharge lamp as claimed in claim 3, wherein the angle of taper $\alpha_2$ a second of the two edge regions of the burner chamber is in the range between 0° and 30°.

14. The bulb for a discharge lamp as claimed in claim 5, wherein the angle of taper $\alpha_2$ of a second of the two edge regions of the burner chamber is in the range between 0° and 30°.

15. The bulb for a discharge lamp as claimed in claim 6, wherein the first of the edge regions faces a reflector.

* * * * *